US006319358B1

(12) United States Patent
Winnick et al.

(10) Patent No.: US 6,319,358 B1
(45) **Date of Patent: *Nov. 20, 2001**

(54) ELECTROLYTIC CAUSTICIZING OF SMELT FROM A KRAFT RECOVERY FURNACE

(75) Inventors: Jack Winnick; Peter H. Pfromm, both of Atlanta, GA (US)

(73) Assignees: Institue of Paper Science and Technology Inc.; Georgia Tech Research Corporation, both of GA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/236,722

(22) Filed: Jan. 25, 1999

Related U.S. Application Data

(60) Provisional application No. 60/087,248, filed on May 29, 1998.

(51) Int. Cl.[7] ..... D21C 11/12

(52) U.S. Cl. ..... 162/30.1; 162/30.11; 162/50; 205/480; 205/494; 205/762; 205/781.5

(58) Field of Search ..... 162/29, 30.1, 50, 162/30.11; 205/480, 494, 746, 758, 759, 762, 781.5, 794.5; 422/186

(56) References Cited

U.S. PATENT DOCUMENTS

| | | | | |
|---|---|---|---|---|
| 3,755,068 | | 8/1973 | Rapson | 162/30 |
| 4,337,126 | | 6/1982 | Gilligan, III et al. | 204/98 |
| 4,799,994 | | 1/1989 | Rimpi | 162/29 |
| 5,534,367 | * | 7/1996 | Kaun | 429/103 |
| 5,624,545 | | 4/1997 | Landfors et al. | 205/746 |
| 5,653,861 | | 8/1997 | Landfors et al. | 205/746 |

FOREIGN PATENT DOCUMENTS

WO94/12720 * 6/1994 (WO) .

OTHER PUBLICATIONS

Lorenz, P.K. and Janz, G.J. "Electrolysis of Molten Carbonates: Anodic and Cathodic Gas–Evolving Reactions", Electrochim. Acta, vol. 15, pp. 1025–1035, 1970.

* cited by examiner

*Primary Examiner*—Dean T. Nguyen
(74) *Attorney, Agent, or Firm*—Fitch, Even, Tabin & Flannery

(57) ABSTRACT

An electrochemical process is provided for treatment of molten kraft smelt produced from black liquor in a kraft recovery boiler. Treated smelt can be contacted with water to produce white liquor which can be re-used or recycled in the kraft process.

16 Claims, 2 Drawing Sheets

ELECTROLYTIC CAUSTICIZING OF SMELT FROM A KRAFT RECOVERY FURNACE

RELATED APPLICATION

This application is based on, and claims the benefit of, U.S. Provisional Application Serial No. 60/087,248, filed May 29, 1998.

FIELD OF THE INVENTION

The invention provides a method of treating waste liquors generated in the kraft pulping process. More particularly, the invention is related to electrolytic treatment of molten kraft smelt in a non-aqueous system. The method of the invention is directed to replacing carbonate present in the molten kraft smelt with hydroxide without significantly modifying sulfides present in the molten kraft smelt.

BACKGROUND OF THE INVENTION

The kraft pulping process is generally the most widely used chemical pulping process employed in the pulp and paper industries. In this process, wood chips or other fibrous materials are heated under pressure with steam in a sodium hydroxide and sodium sulfide solution. The resulting pulp is generally used to make brown paper. It can also be bleached to produce white pulp for writing and other higher grade papers.

The filtrate and washings from the pulping process—the so-called "black liquor"—generally contain dissolved organic materials from the wood as well as spent pulping chemicals. The black liquor is normally concentrated in evaporators and then burned under both oxidizing and reducing conditions in a boiler or combustor. The combustion of the organic matter contained in the black liquor produces high pressure steam which can be used to generate electricity. The inorganic materials form a molten kraft smelt on the bottom of the combustor. The typical kraft smelt primarily contains sodium and potassium carbonate, sodium sulfide, and sodium sulfate.

Molten kraft smelt, generally at a temperature of about 750° to 950° C., is normally removed from the bottom of the boiler via water-cooled troughs (the so-called smelt spouts) and fed directly into an aqueous solution contained in a dissolving tank. Thus, the kraft smelt is fed into the dissolving tank while still in the molten state. The kraft smelt dissolves in the aqueous solution and produces a so-called "green liquor". The green liquor, after filtering or clarifying to remove undissolved materials, is subjected to a recausticizing operation. The green liquor is treated with lime to convert the sodium carbonate into sodium hydroxide through slaking and causticizing reactions. In the slaking reaction, calcium oxide is converted to calcium hydroxide; in the causticizing reaction, the calcium hydroxide reacts with sodium carbonate to produce calcium carbonate and sodium hydroxide. This lime-treatment process produces kraft "white liquor" containing the pulping chemicals which can then be reused or recycled in the kraft pulping system.

The recausticizing operation for kraft pulping also involves a reaction train, known as the calcium cycle, to replace $CO_3^{2-}$ in the green liquor with $OH^-$ needed for kraft cook. CaO is reacted with the $Na_2CO_3$ in the green liquor to form $CaCO_3$, which is separated. The $CaCO_3$ is re-burned to form CaO in a lime kiln, and carbon is released as $CO_2$. This closes the calcium cycle.

One of the largest industrial processes involving inorganic chemistry in the U.S. is the recovery of inorganic pulping chemicals for the kraft process in the pulp and paper industries. One major part of this process is recausticizing. This chemical recovery system forms an important and vital part of the paper-making process. Indeed, without the chemical recovery system, the kraft system would be prohibitively expensive. Moreover, the disposal of the black liquor would likely be impossible in an environmentally acceptable manner.

This chemical recovery process or system has, however, a number of problems and/or limitations. For example, feeding molten kraft smelt (normally about 750° C. or higher) directly into an aqueous solution can result in, and often has resulted in, explosions in the dissolving tank. Such explosions, in addition to potentially damaging equipment and injuring personnel, can release significant amounts of sulfur-containing pollutants into the environment, especially into the atmosphere. Also, it is difficult to control the green liquor concentration when feeding molten kraft smelt. Finally, the lime cycle poses many problems. Chemical equilibrium limits the conversion of carbonate. The operation of the lime kiln has significant environmental impact as a result of gaseous and particulate emissions. Fossil fuels are burned in the kiln in an inefficient and hard-to-control operation. In low effluent pulp production, enrichment of elements such as Mg, Al, and P can lead to serious disturbances in the lime cycle. Large amounts of non-process elements are introduced into the pulping operation from replacement lime.

Moreover, the production of many current mills is significantly limited by the recausticizing operation. Incremental capacity cannot easily be installed, due to the nature of the calcium/lime cycle. In addition, many mills are limited in the space available for equipment.

Considerable efforts have been made to improve the existing kraft recovery process or to provide alternative kraft recovery processes. See, for example, Nishizawa et al., "Chemical Recovery Process by Direct Carbonation of Smelt," Proc. IUPAC/EUCEPA Symposium on Recovery of Pulping Chemicals (Helsinki) 659–73 (1968); Grace, "Gasification: Route to the Promised Land?'", 70 *PIMA* 75–76 (1988); Empie, "Alternative Kraft Recovery Processes," 74 Tappi J. 272–76 (1991); DeNovo et al., U.S. Pat. No. 4,303,496 (Dec. 1, 1981); Empie, U.S. Pat. No. 4,441,959 (Apr. 10, 1984); Feldmann, U.S. Pat. No. 4,522,685 (Jun. 11, 1985); and Empie, U.S. Pat. No. 4,526,760 (Jul. 2, 1985). Although the overall process has been improved in a number of ways, the kraft recovery process generally employed today still involves feeding molten kraft smelt directly into an aqueous solution in the dissolving tank to produce green liquor followed by further physical and chemical treatment to produce white liquor.

It would be desirable, therefore, to provide a kraft recovery system which eliminates the steps of producing green liquor and treating the green liquor to produce white liquor. Such a system would avoid the process control difficulties inherent in these steps. It would be desirable to provide a kraft recovery system that eliminates the entire recausticizing operation, with its many pollution sources, ill-defined process steps and low energy efficiency. It would also be desirable to provide a kraft recovery system with significantly increased energy efficiencies, limited sulfurous emissions and minimal solids handling. The present invention provides such a kraft recovery system. Moreover, the kraft recovery system provided by the present invention can be incorporated into existing kraft recovery systems with relative ease.

SUMMARY OF THE INVENTION

The invention relates generally to the process of treating waste liquors generated during the process of making pulp and, specifically, treating the molten inorganic smelt obtained in a kraft recovery furnace. More particularly, in accordance with the invention, the molten kraft smelt is processed in a non-aqueous electrolytic cell. The treated smelt, after being dissolved in water, is suitable for re-use or recycle in the kraft pulping process.

Generally, in the process of making pulp, molten kraft smelt is produced when black liquor is burned in a recovery boiler. The molten kraft smelt comprises primarily sodium carbonate, potassium carbonate and sodium sulfide, and, in addition, lesser amounts of sodium sulfate, sodium chloride and inerts, such as metals, transition metals and carbon. Preferably in the process of this invention, the molten kraft smelt, which forms at the bottom of the boiler, can be fed by gravity directly from the recovery boiler to an electrolytic cell for treatment. The molten inorganic smelt obtained from the kraft recovery furnace can be introduced into the electrolytic cell from the boiler without cooling or other treatment, such as the addition of water.

The electrolytic cell comprises an external voltage source, a cathode, and an anode. The cell also may comprise flow baffles or one or more porous convection barriers. The cathode preferably is an inert metal cathode and may be stainless steel, titanium diboride, any suitable brass or bronze or the like. The anode may be a carbon sacrificial electrode or the like or may be an inert electrode (e.g., metal alloys, ceramics or the like).

An electrical potential is applied between the electrodes during treatment of the molten kraft smelt. The potential applied will vary according to the materials used for the electrodes and the geometry of the cell. Preferably, the potential applied to the cell is selected to be effective for converting sodium carbonate present in the molten kraft smelt to sodium oxide when no steam is used or to sodium hydroxide when steam is used. In an important aspect of the invention, the potential is selected to essentially prevent sulfide present in the molten smelt from being oxidized or in any other way modified by electrolysis.

In another embodiment, steam may be introduce below the surface of the molten kraft smelt at the cathode during electrolysis. The steam is electrolytically reduced to hydrogen and hydroxyl ions, with the hydrogen being removed from the smelt as a gas and the hydroxyl ions remaining in the smelt. Steam is introduced at a rate effective for reacting with the carbonate. Preferably, a stoichiometric amount of steam is introduced to causticize the carbonate present in the cell. In an important aspect, the rate at which the steam is introduced is limited to no more than the stoichiometric amount so as to prevent formation of hydrogen sulfide.

Preferably, significant movement of hydrogen gas or oxide ions from the cathode to the anode is prevented. In a flow-through system, flow baffles, or other means of providing a tortuous flow path, may be used to prevent such movement. In a batch system, a porous convection barrier may be used.

At the anode, carbonate in the smelt is electrolytically oxidized to $CO_2$ and $O_2$. As a result of this electrolytic process, at least about 75% wt., and more preferably at least about 90% wt., of the sodium and potassium carbonate present in the molten kraft smelt is converted to sodium and potassium hydroxide. The smelt that has been treated in the electrolytic cell can be dissolved in water to form "white liquor" which contains chemicals used for kraft pulping. Thus, the white liquor is suitable for recycle or re-use in the process of making pulp.

For purposes of this invention, "black liquor" means the filtrate and/or wash water generated from filtering and washing of brown pulp according to a kraft process for making pulp, wherein the black liquor comprises dissolved organic matter and spent chemicals. By "molten kraft smelt" is meant the smelt generated at the bottom of a recovery boiler when black liquor is burned, the molten kraft smelt comprising primarily sodium carbonate, potassium carbonate and sodium sulfide, and, to a lesser extent, sodium sulfate, sodium chloride and inerts, such as metals, transition metals and carbon. By "green liquor" is meant the liquor generated by addition of water to kraft smelt; the "green liquor" comprises sodium carbonate, sodium sulfide, inorganic chemicals and sodium sulfate. By "white liquor" is meant the caustic liquor produced by filtering or clarifying green liquor followed by addition of lime in accordance with conventional methods. "White liquor" also includes the liquor produced by addition of water to kraft smelt treated in accordance with the method of the present invention. By "non-aqueous system" is meant a system having no more than a negligible amount of water or, more preferably, being essentially water-free. Under the process conditions encountered when practicing the method of the invention, it is expected that water will not be present in a liquid state. By "deadload" is meant the amount of inorganic chemicals that are neither converted nor recovered but are continuously recirculated through the kraft pulping process.

It is an object of the invention to provide an method of treating "black liquor" generated in the kraft process of making pulp using an electrolytic, non-aqueous system. This electrolytic system is designed to replace the conventional calcium cycle in the kraft process, including the lime kiln, clarifiers, mud filtration and causticizing vessels. It is a further object of the present invention to improve causticizing efficiency by removing the limitations of chemical equilibrium and to reduce the deadload of inactive inorganic chemicals circulated in the liquors. It is a further object of the present invention to provide a method of treating molten kraft smelt in an electrolytic system to convert sodium and potassium carbonate in the molten kraft smelt to remove carbonate as CO and/or $CO_2$, without introducing impurities into the system. It is a still further object of the invention to prevent sulfides present in the molten kraft smelt from being oxidized or otherwise converted in the electrolytic process.

DETAILED DESCRIPTION OF THE PREFERRED EMBODIMENTS

The present invention relates to a method of treating waste liquors generated during the kraft pulping process. Molten kraft smelt generated when black liquor is burned in a recovery boiler is treated directly to obtain white liquor. The molten kraft smelt is directed to an electrolytic cell wherein sodium and potassium carbonate are converted to their respective oxides or hydroxides. In addition, molten kraft smelt from alternative black liquor treatment processes also can be treated using the methods of this invention. For example, molten kraft smelt from the integrated spent liquor recovery process or processes described in U.S. Pat. Nos. 4,303,496, 4,441,959, 4,522,685 and 4,526,760, all of which are hereby incorporated by reference, or molten kraft smelt from the molten salt gasification process developed by Rockwell International and Champion International can be treated with the process of this invention. Thus, the conventional process steps in the kraft process whereby green liquor is produced and treated are eliminated. The great amount of equipment required for the lime cycle in the traditional operation is replaced with one or more compact electrolytic cells. The process also allows the capacity of existing conventional causticizing operations to be increased.

Figure 1:
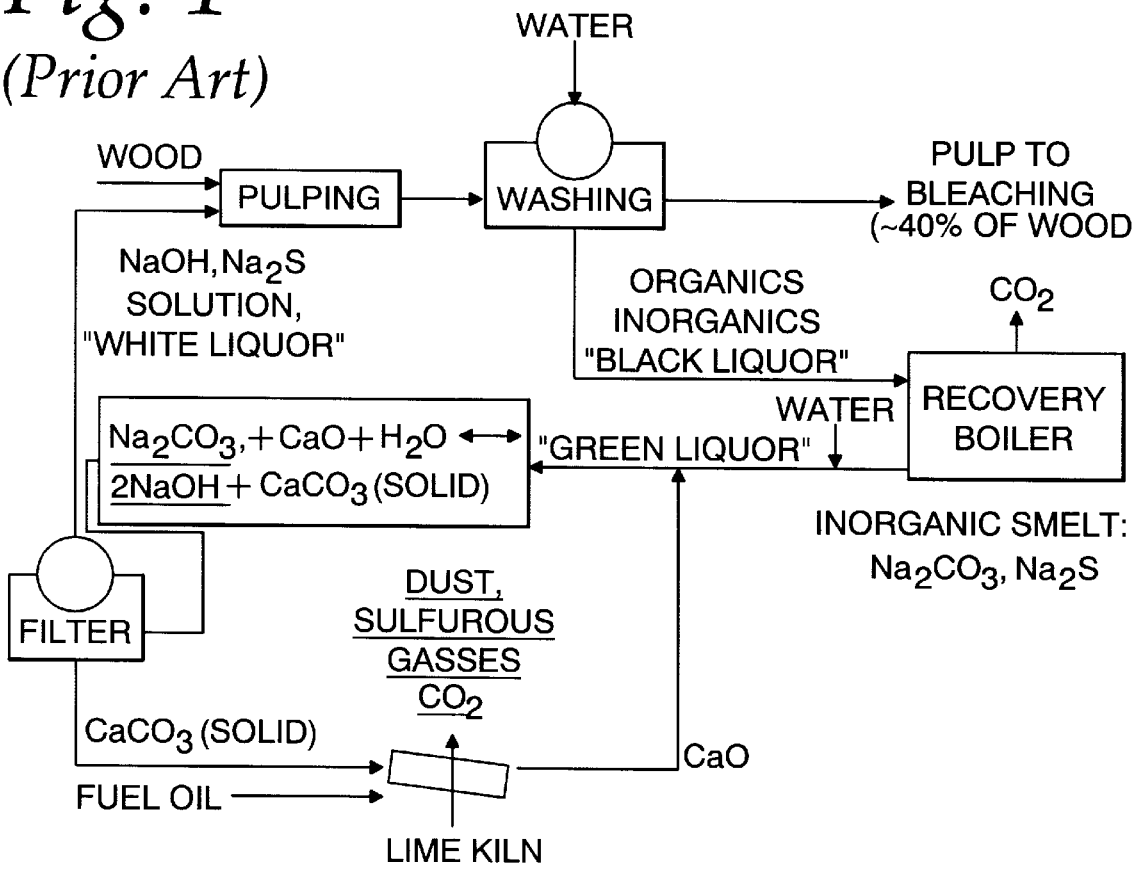
Fig. 1 (Prior Art)
FIG. 1 is process flow diagram of showing the steps of a kraft recovery process as known in the prior art.

FIG. 1 illustrates a conventional kraft pulping process. The filtrate and wash water generated from brown pulp is collected as "black liquor". The black liquor typically is concentrated in an evaporator and then burned under reducing and oxidizing conditions in a recovery boiler or combustor. Next, the resultant molten kraft smelt is contacted with water to form green liquor, which is subjected to physical and chemical treatment to provide ultimately white liquor. The white liquor is suitable for re-use or recycle in the kraft pulping process. The treatment of molten kraft smelt in such a conventional process is a difficult and often process limiting step in the kraft pulping process.

Figure 2:
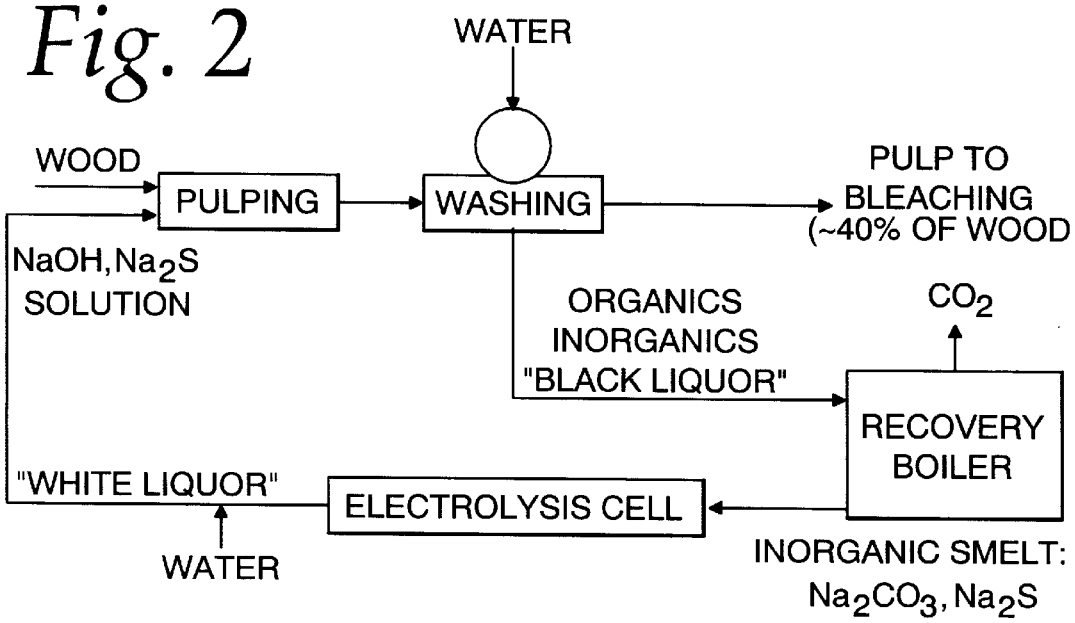
FIG. 2 is process flow diagram showing the steps of a kraft recovery process in accordance with the present invention.

In accordance with the method embodying the present invention, however, the molten kraft smelt is electrolytically causticized to produce a smelt, which, when contacted with water, produces white liquor, as shown in FIG. 2. This essentially allows the conventional molten kraft smelt treatment steps and process equipment to be eliminated. The molten kraft smelt is removed from the kraft recovery boiler via the smelt spouts and directed to an electrolytic cell. The molten kraft smelt is present in the boiler at temperatures of from about 750° to about 950° C. Preferably, the molten kraft smelt enters the electrolytic cell at a temperature of from about 850° to about 900° C. At the anticipated process conditions, water should not be present in a liquid state; thus, the system essentially is a non-aqueous one.

The molten kraft smelt found in the kraft recovery boiler generally comprises primarily sodium carbonate, potassium carbonate and sodium sulfide, and, to a lesser extent, sodium sulfate, sodium chloride and inerts, such as metals, transition metals and carbon. For example, the composition of a typical kraft smelt is about 72 weight percent sodium carbonate and potassium carbonate, about 21 weight percent sodium sulfide, about 4 weight percent sodium sulfate, about 2 weight percent sodium chloride and about 1 weight percent inerts. As those skilled in the art will realize, the composition of the kraft smelt can vary from these typical values without adversely affecting the present invention.

Figure 3:
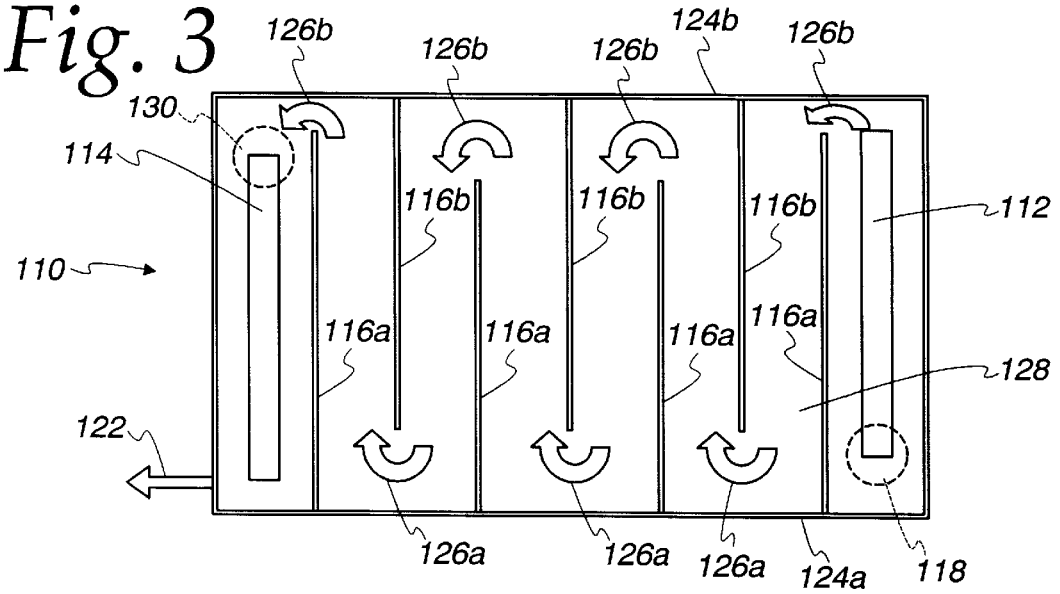
FIG. 3 is a top or plan view of a flow-through electrolytic cell used for treatment of molten kraft smelt in a continuous process.
Figure 4:
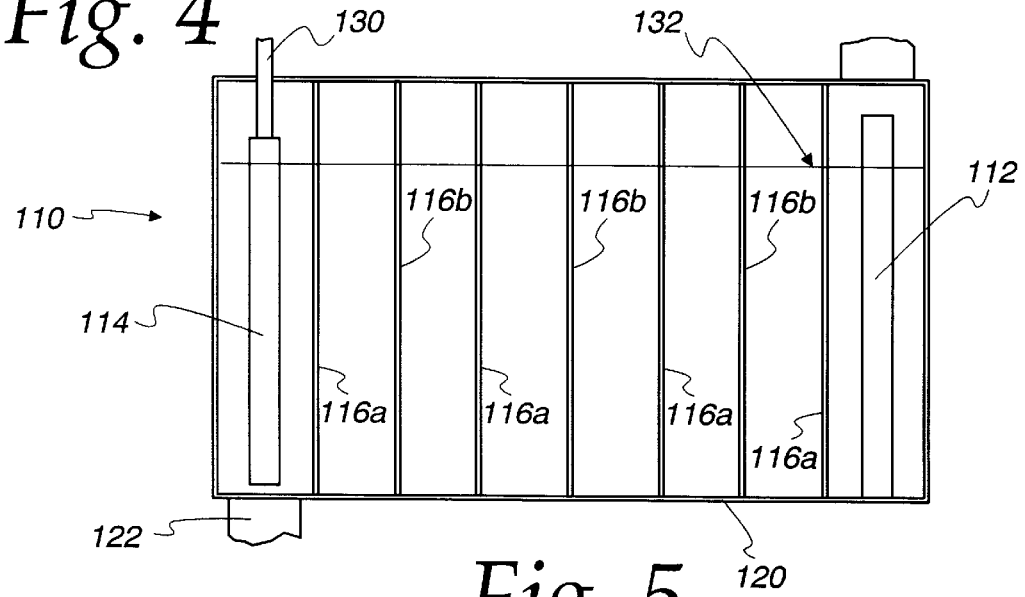
FIG. 4 is an elevational view of a cross section of the cell of FIG. 3.

From the smelt spouts or other similar spouts, the molten kraft smelt is directed from the kraft recovery boiler for treatment as a batch, semi-continuous or continuous process. Preferably a continuous process is employed, with the electrolytic cell positioned below the kraft recovery boiler smelt spouts. Referring to FIGS. 3 and 4, the electrolytic cell 110 for a continuous process generally comprises an anode 112, a cathode 114 and at least one baffle 116.

By positioning the cell 110 below the kraft recovery boiler smelt spouts 118, the molten kraft smelt is gravity fed through the spouts 118 into the cell 110. The smelt is fed into the cell 110 in the vicinity of the anode 112. An angled bottom 120 allows the molten smelt to flow by gravity through the cell 110 from the anode 112 to the cathode 114. Preferably, the smelt spouts 118 are positioned to feed the molten smelt into the cell 110 at a location 118 as far upstream as possible (i.e., adjacent to the end of the cell containing the anode). The molten smelt exits the cell 110 in the vicinity of the cathode 114 through exit spouts 122. The exit spouts 122 may be of the type used for kraft recovery boiler spouts or other similarly configured spouts. Preferably, the treated smelt flows by gravity through the exit spouts 122 into an adjacent water reservoir.

In a continuous system, preferably, one or more baffles 116 of length shorter than the width of the cell 110 are arranged parallel to one another down the length of the cell 110. Alternating baffles 116*a* are connected to one side 124*a* of the cell 110, with the remaining baffles 116*b* connected to the opposite side 124*b* of the cell 110 to create a tortuous flow path 126 for the smelt as it flows from the anode 112 to the cathode 114. The smelt flows laterally across the cell 110 in one direction 126*a* but changes direction 126*b* at the opposite side 124 as it flows around the end of the baffle 116. The number of baffles 116 used and the width of the resulting flow channel 128 are determined by, among other factors, the dimensions of the cell 110 and the desired residence time. Of course, the number of baffles 116 and the geometries of the baffles 116 within the cell can be varied so long as a tortuous flow path is maintained.

Alternatively, if it is not possible to process the smelt immediately, the molten kraft smelt can be cooled, stored for a length of time and then, when treatment is desired, reheated to achieve a molten state. For example, during a power failure or equipment breakdown, it may not be possible to treat the molten kraft smelt. In such a case, the smelt can be held in the recovery boiler and subsequently reheated within the recovery boiler to achieve a molten state. Molten kraft smelt from the recovery boiler can be introduced into the electrolytic cell to reheat any smelt remaining therein that has cooled. Additionally, heating elements or other ancillary heating mechanisms can be used as necessary to reheat any cooled smelt held in the electrolytic cell.

The electrolytic cell 110 is sized according to the volume of smelt to be processed and the residence time required to achieve the desired conversion of carbonate. For example, in a pulp mill that produces about 1000 tons per day of pulp, about 570 metric tons of molten kraft smelt must be processed per day. Preferably, the volume of the electrolytic cell 110 is about 10 cubic meters to provide a residence time of about 1 hour. Of course, more than one electrolytic cell 110 can be used. The electrolytic cell 110 and baffles 116 are constructed of a material capable of withstanding the extreme conditions experienced in the cell 110. Suitable construction materials may include stainless steel, inert ceramics, such as alumina and zirconia, and conductive ceramics, such as titanium diboride and ebonex ($Ti_4O_7$).

Preferably, the cathode 114 is an inert material, and, most preferably, both the cathode 114 and the anode 112 are inert materials. Inert electrodes are preferred to prevent deterioration of the electrode so as to eliminate the need to replace the electrodes which can be costly and time consuming. Suitable metals for the cathode include carbon, graphite, stainless steel, titanium diboride, brass, bronze and the like. Most preferably, the cathode is carbon. Suitable materials for a sacrificial anode include carbon, such as the anodes used in the Hall-Heroult process of aluminum production, and the like. Suitable materials for an inert anode, include metal alloys, ceramics and the like.

Figure 5:
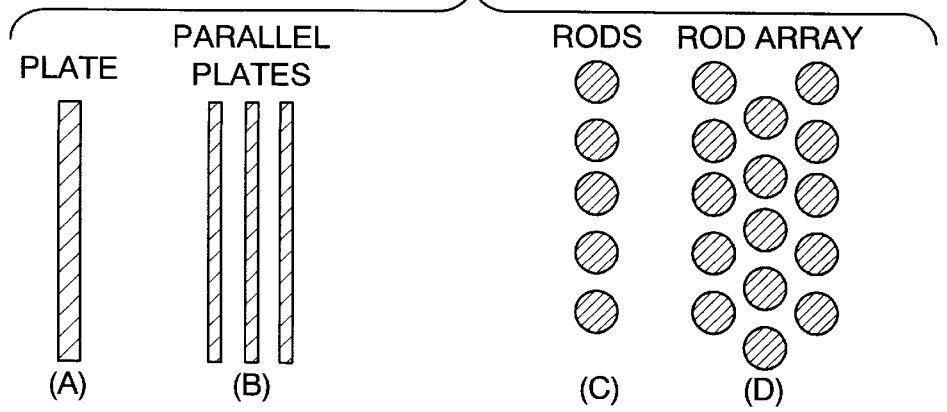
FIG. 5 is a schematic view of four alternative geometries for electrodes used in the cell of FIG. 3.

The size and geometry of the electrodes 112 and 114 will vary according to the materials selected. For example, one or more cylindrical or flat plate electrodes are suitable, although mesh configurations, or other geometries to increase the surface area of the electrodes, may be desirable. Spacing of the electrodes 112 and 114 within the cell 110 also will vary according to the material and geometry selected. FIG. 5 shows four potential geometries and configurations for the electrodes 112 and 114. As shown in (A) and (B), the electrodes may be flat plate, with one larger plate (A) or more than one smaller plates (B) arranged in parallel. Alternatively, the electrodes may be rods, as shown in (C) and (D). Multiple rods may be arranged in a row, with one (C) or more (D) rows being possible. In all cases, the electrodes 112 and 114 preferably are positioned laterally in the cell 110, parallel to the baffles 116, as shown generally in FIG. 3. Thus, the width of the channel 128 limits the number of rows of electrodes 112 and 114.

Treatment of the molten kraft smelt is directed to converting alkali metal carbonate to alkali metal oxides or alkali metal hydroxides. The alkali metal oxides are subsequently converted to alkali metal hydroxides when contacted with water. Using the method of the present invention, it is possible to convert at least about 75% wt. of the carbonate present as sodium and potassium carbonate in the molten kraft smelt. Preferably, at least about 90% wt. is converted, and most preferably, essentially all of the carbonate is converted. Carbonate is removed from the electrolytic cell as CO and/or $CO_2$ gas. Chemical equilibrium or other process limitations do not limit the extent of the carbonate conversion because these gaseous reaction products are removed from the electrolytic cell.

Other components of the molten kraft smelt also may be affected by electrolysis. For example, residual sodium sulfate present in the molten kraft smelt may be electrolytically converted to useful sodium sulfide. Sodium chloride may be converted to chlorine gas and removed from the system. Also, metals may be plated out at the cathode. These reactions will not negatively impact treatment of the molten kraft smelt and, in fact, are beneficial.

The primary reactions that will occur at the anode and cathode depend on the operating conditions and electrode materials selected. If a sacrificial carbon anode is used, carbonate ions in the molten kraft smelt are oxidized to carbon monoxide without steam injection or to carbon dioxide with steam injection by consuming carbon from the anode. Carbonate ions combine with carbon from the anode to form carbon monoxide and/or carbon dioxide. Both the carbon dioxide and carbon monoxide are removed from the cell as gases. If an inert anode is used, carbonate ions in the molten kraft smelt are oxidized to carbon dioxide at the anode. The carbon dioxide is removed from the cell as a gas.

The electrolytic cell is connected to an external source of direct current to supply electrical energy to force the desired reactions to occur. An electrical potential is applied between the electrodes. As a result of the difference in potentials, an electric charge is transferred by electrons flowing from the anode to the cathode through the external circuit.

When selecting the potential to be applied, the following thermodynamic equations are considered:

| | | EMF (volts) |
|---|---|---|
| A. No Steam/Carbon Anode | | |
| Desirable: | | |
| 1. Anode: | $2CO_3^{2-} + 4C \longleftrightarrow 6CO + 4e^-$ | |
| Cathode: | $CO_3^{2-} + 4e^- \longleftrightarrow C + 3O^{2-}$ | |
| Combined: | $3Na_2CO_3 + 3C \longleftrightarrow 6CO + 3Na_2O$ | −0.94 |
| 2. Anode: | $CO_3^{2-} + 2C \longleftrightarrow 3CO + 2e^-$ | |
| Cathode: | $CO_3^{2-} + 2e^- \longleftrightarrow CO + 2O^{2-}$ | |
| Combined: | $2Na_2CO_3 + 2C \longleftrightarrow 4CO + 2Na_2O$ | −1.26 |
| Undesirable: | | |
| 3. Anode: | $2O^{2-} + 2C \longleftrightarrow 2CO + 4e^-$ | |
| Cathode: | $CO_3^{2-} + 4e^- \longleftrightarrow C + 3O^{2-}$ | |
| Combined: | $2Na_2O + C + Na_2CO_3 \longleftrightarrow 2CO + 3Na_2O$ | −0.31 |
| 4. Anode: | $O^{2-} + C \longleftrightarrow CO + 2e^-$ | |
| Cathode: | $CO_3^{2-} + 2e^- \longleftrightarrow CO + 2O^{2-}$ | |
| Combined: | $Na_2O + C + Na_2CO_3 \longleftrightarrow 2CO + 2Na_2O$ | −0.63 |
| 5. Anode: | $2O^{2-} + C \longleftrightarrow CO_2 + 4e$ | |
| Cathode: | $2CO_3^{2-} + 4e^- \longleftrightarrow 2CO + 4O^{2-}$ | |
| Combined: | $2Na_2O + C + 2Na_2CO_3 \longleftrightarrow CO_2 + 2CO + 4Na_2O$ | −0.73 |
| 6. Anode: | $O^{2-} + C \longleftrightarrow CO + 2e^-$ | |
| Cathode: | $2CO_2 + 2e^- \longleftrightarrow CO + CO_3^{2-}$ | |
| Combined: | $Na_2O + C + 2CO_2 \longleftrightarrow 2CO + 2Na_2CO_3$ | 1.04 |
| 7. Anode: | $2S^{2-} + C \longleftrightarrow CS_2 + 4e^-$ | |
| Cathode: | $2CO_3^{2-} + 4e^- 4O^{2-} + 2CO$ | |
| Combined: | $2Na_2S + C + 2Na_2CO_3 \longleftrightarrow CS_2 + 4Na_2O + 2CO$ | −1.89 |
| B. No Steam/Inert Anode | | |
| Desirable: | | |
| 8. Anode: | $CO_3^{2-} \longleftrightarrow CO_2 + 0.5O_2 + 2e^-$ | |
| Cathode: | $CO_3^{2-} + 2e^- \longleftrightarrow CO + 2O^{2-}$ | |
| Combined: | $2Na_2CO_3 \longleftrightarrow CO_2 + 0.5O_2 + CO + 2Na_2O$ | −2.59 |
| 9. Anode: | $2CO_3^{2-} \longleftrightarrow 2CO_2 + O_2 + 4e^-$ | |
| Cathode: | $CO_3^{2-} + 4e^- \longleftrightarrow C + 3O^{2-}$ | |
| Combined: | $3Na_2CO_3 \longleftrightarrow 2CO_2 + O_2 + C + 3Na_2O$ | −2.28 |
| Undesirable: | | |
| 10. Anode: | $20^{2-} \longleftrightarrow O_2 + 4e^-$ | |
| Cathode: | $CO_3^{2-} + 4e^- \longleftrightarrow C + {}_3O^{2-}$ | |
| Combined: | $2Na_2O + Na_2CO_3 \longleftrightarrow O_2 + C + 3Na_2O$ | −1.44 |
| 11. Anode: | $O^{2-} \longleftrightarrow 0.5O_2 + 2e^-$ | |
| Cathode: | $CO_3^{2-} + 2e^- \longleftrightarrow CO + 2O^{2-}$ | |
| Combined: | $Na_2O + Na_2CO_3 \longleftrightarrow 0.5O_2 + CO + 2Na_2O$ | −1.76 |
| 12. Anode: | $O^{2-} \longleftrightarrow 0.5O_2 + 2e^-$ | |
| Cathode: | $2CO_2 + 2e^- \longleftrightarrow CO + CO_3^{2-}$ | |
| Combined: | $Na_2O + 2CO_2 \longleftrightarrow 0.5O_2 + CO + Na_2CO_3$ | −0.09 |
| 13. Anode: | $S^{2-} \longleftrightarrow 0.5S_2 + 2e^-$ | |
| Cathode: | $CO_3^{2-} + 2e^- \longleftrightarrow CO + 2O^{2-}$ | |
| Combined: | $Na_2S + Na_2CO_3 \longleftrightarrow 0.5S_2 + CO + 2Na_2O$ | −1.93 |
| C. Steam Injection/Carbon Anode | | |
| Desirable: | | |
| 14. Anode: | $2CO_3^{2-} + C \longleftrightarrow 3CO_2 + 4e^-$ | |
| Cathode: | $4H_2O + 4e^- \longleftrightarrow 4OH^- + 2H_2$ | |
| Combined: | $2Na_2CO_3 + C + 4H_2O \longleftrightarrow 3CO_2 + 4NaOH + 2H_2$ | −0.28 |
| Undesirable: | | |
| 15. Anode: | $2S^{2-} + C \longleftrightarrow CS_2 + 4e^-$ | |
| Cathode: | $4H_2O + 4e^- \longleftrightarrow 4OH^- + 2H_2$ | |
| Combined: | $2Na_2S + C + 4H_2O \longleftrightarrow CS_2 + 4NaOH + 2H_2$ | −0.60 |
| D. Steam Injection/Inert Anode | | |
| Desirable: | | |
| 16. Anode: | $CO_3^{2-} \longleftrightarrow CO_2 + 0.5O_2 + 2e^-$ | |
| Cathode: | $2H_2O + 2e^- \longleftrightarrow 2OH^- + H_2$ | |
| Combined: | $Na_2CO_3 + 2H_2O \longleftrightarrow CO_2 + 0.5O_2 + 2NaOH + H_2$ | −1.31 |

-continued

| | | EMF (volts) |
|---|---|---|
| 17. Anode: | $S^{2-} \longleftrightarrow 0.5S_2 + 2e^-$ | |
| Cathode: | $2H_2O + 2e^- \longleftrightarrow 2OH^- + H_2$ | |
| Combined: | $Na_2S + 2H_2O \longleftrightarrow 0.5S_2 + 2NaOH + H_2$ | −0.65 |

When steam is present in excess of stoichiometric needs, the following undesirable reaction will occur:

$$Na_2S+2H_2O \leftrightarrow 2NaOH+H_2S \quad 18.$$

When smelt is introduced into water after electrochemical causticizing, hydroxide also is produced from $Na_2O$ and Na:

$$Na_2O+H_2O \leftrightarrow 2NaOH \quad 19.$$

$$Na+H_2O \leftrightarrow NaOH+0.5H_2 \quad 20.$$

In treating molten kraft smelt according to the method of the present invention, sulfate will be converted to desired sulfide, which is advantageous compared to a conventional recausticizing process, where sulfate is a deadload in the process. Thus, reduction of sulfate to sulfide could be accomplished entirely by electrochemistry, which as a result would allow burning of black liquor under purely oxidizing conditions.

| | n(e−) | EO (Volts) | delta G (kJ/mol) |
|---|---|---|---|
| Oxidation (chemical reaction) | | | −174.522 |
| $SO_4^{2-} + 2C \longleftrightarrow S^{2-} + 2CO_2$ | | | |
| $Na_2SO_4 + 2C \longleftrightarrow Na_2S + 2CO_2$ | | | |
| Electrochemical | 8 | −0.5063 | 390.826 |
| $4CO_3^{2-} + 4C \longleftrightarrow 4CO + 4CO_2 + 8e^-$ | | | |
| $SO_4^{2-} + 8e^- \longleftrightarrow S^{2-} + 4O^{2-}$ | | | |
| $4Na_2CO_3 + 4C + Na_2SO_4 \longleftrightarrow Na_2S + 4Na_2O + 4CO + 4CO_2$ | | | |
| Or | 8 | −0.6088 | 469.906 |
| $4CO_3^{2-} + 2C \longleftrightarrow 6CO_2 + 8e^-$ | | | |
| $SO_4^{2-} + 8e^- \longleftrightarrow S^{2-} + 4O^{2-}$ | | | |
| $4Na_2CO_3 + 2C + Na_2SO_4 \longleftrightarrow Na_2S + 4Na_2O + 6CO_2$ | | | |

The potential applied to the cell is effective for causing the desired reactions, as labeled, to occur. In an important aspect of the invention, the potential is selected to prevent further reactions of sulfide in the molten smelt according to reactions 7, 13, 15 and 17. Reactions 3–6 and 10–12 are effectively prevented by utilizing a convection barrier in a batch system or the tortuous flow path in a continuous system.

Current density is defined as the current flowing between the electrodes divided by the electrode area. The voltage between the electrodes in the cell is determined by the shape, composition and placement of the electrodes, as well as the temperature and composition of the smelt, the type of barrier used and the reactions desired. For example, current density in the cell generally ranges from about 0.02 to about 5 $A/cm^2$, or even higher. The absolute current is determined by the volume of smelt to be processed per time, as well as the current efficiency, which takes into account the current lost due to resistance in the cell and undesirable reactions.

In an alternative embodiment, steam may be introduced into the molten kraft smelt at the cathode 114 as a source of hydroxyl ions. A pipe 130, or other similar device, positioned in close proximity to the cathode 114 is used to introduce the steam below the surface 132 of the molten kraft smelt. Alternatively, if a porous cathode is selected, steam may be introduced through the pores of the cathode. The steam dissociates into hydroxyl ions and hydrogen gas in the vicinity of, or at, the cathode 114 surface. The hydrogen is removed as a gas from the cell 110. The hydroxyl ions remain in the molten kraft smelt, migrating away from the cathode 114.

If steam is used, introduction of an approximate, but not more than, stoichiometric amount of hydroxyl ions to react with the carbonate in the molten kraft smelt is preferred. The moles of steam introduced at the cathode 114 per unit of time preferably is less than or equal to the value of Faraday's constant ($9.648\times10^4$ C/mol) divided by the electrical current passed between the electrodes 112 and 114. Introduction of an excess amount of steam should generally be avoided to prevent any excess steam from reacting with sulfide present in the molten kraft smelt. The molar flow rate of steam is equal to the molar flow rate of carbonate entering the cell multiplied by the weight fraction (e.g., preferably at least about 0.75 and more preferably at least about 0.90) of carbonate to be causticized. Because the steam is introduced below the surface 132 of the molten kraft smelt, the steam pressure should exceed the hydrostatic pressure of the smelt at the depth at which the steam is injected.

If steam is not used at the cathode, carbonate ions are reduced at the cathode to carbon monoxide and oxide ions. Under these conditions, the cell potential may be higher than when steam is introduced into the cell.

It is desirable to limit substantial convective transport to the anode of negative ions formed at the cathode. These ions otherwise may be oxidized at the anode, resulting in a great decrease of current efficiency. Thus, limiting movement of hydrogen gas or oxide ions toward the anode minimizes unwanted side reactions in the cell. For example, the reactions $$H_2+S^{2-} \leftrightarrow H_2S+2e^- \quad \text{(with steam injection)}$$
$$2O^- \leftrightarrow O_2+2e^- \quad \text{(without steam injection)}$$

can be avoided. As discussed, in a continuous system, a tortuous flow path is created for this purpose using baffles. In a batch system, the electrolytic cell preferably comprises a porous convection barrier. The barrier is selected to be effective for limiting movement from the cathode 114 to the anode 112 of hydrogen gas or oxide ions entrained in the molten kraft smelt.

After treatment in the electrolytic cell, the molten kraft smelt is removed. The treated smelt exits the cell 110 at the cathode 114 by gravity flow through smelt spouts 122 of the type used in the kraft recovery boiler or the like. The treated smelt is then contacted with water in a water reservoir to produce white liquor, which can be re-used or recycled in the kraft process. Prior to entering the water reservoir, water jets can be employed to break up the smelt stream to aid dissolution.

Numerous modifications to the invention are possible to further improve the process of electrolytically treating molten kraft smelt in a non-aqueous system. Thus, modifications and variations in practice of the invention will be apparent are expected to those skilled in the art upon consideration of the foregoing detailed description of the invention. Although preferred embodiments have been described above and illustrated in the accompanying drawings, there is no intent to limit the scope of the invention to these or other particular embodiments.

What is claimed is:

1. A method for electrolytically treating molten Kraft smelt to provide sodium sulfide to a Kraft process, the molten Kraft smelt comprising sodium sulfide, sodium sulfate, sodium chloride and alkali metal carbonates, the method comprising:

providing an electrolytic cell having an anode and a cathode;

feeding the molten Kraft smelt into the cell, wherein the molten Kraft smelt comprises sodium carbonate, potassium carbonate, sodium sulfide, sodium sulfate and sodium chloride, the molten Kraft smelt having a temperature of from about 750° C. to about 950° C.; and applying an electrical potential which is effective for preventing reactions of sulfide in the molten Kraft smelt, the potential between the anode and the cathode with the molten Kraft smelt therebetween in an environment that is substantially without liquid water, whereby the method is effective for providing sodium sulfide to a Kraft process and at least about 75% of the alkali metal carbonates in the molten Kraft smelt are converted to alkali metal oxides or alkali metal hydroxides.

2. A method in accordance with claim 1, wherein the electrolytic cell is provided with a porous convection barrier effective for limiting migration of negative ions toward the anode.

3. A method in accordance with claim 1, wherein the electrolytic cell is provided with a tortuous path effective for limiting migration of negative ions toward the anode.

4. A method in accordance with claim 1, wherein the cathode is comprised of a material selected from the group consisting of carbon, graphite, stainless steel, titanium diboride, brass and bronze.

5. A method in accordance with claim 4 further comprising introducing steam to the molten kraft smelt at the cathode.

6. A method in accordance with claim 5, wherein steam is introduced at a rate no greater than stoichiometrically required to react with the alkali metal carbonates.

7. A method in accordance with claim 5 further comprising removing the treated molten kraft smelt from the electrolytic cell and contacting the treated smelt with water to produce a caustic liquor.

8. A method in accordance with claim 5 further comprising removing the treated molten kraft smelt from the electrolytic cell and contacting the treated smelt with water to convert alkali metal oxides to alkali metal hydroxides.

9. A method in accordance with claim 4, wherein the anode is comprised of carbon.

10. A method in accordance with claim 4, wherein the anode is comprised of a material selected from the group consisting of metal alloy and ceramic.

11. A method for electrolytically treating molten Kraft smelt generated in a process for making pulp, the method to provide sodium sulfide to a Kraft process, the method comprising:

filtering and washing brown pulp to generate a waste liquor having dissolved organic materials and spent pulping chemicals;

feeding the waste liquor to an evaporator wherein the waste liquor is concentrated;

burning the concentrated waste liquor to produce a molten Kraft smelt comprising sodium sulfide, sodium sulfate, sodium chloride and alkali metal carbonates selected from the group consisting of sodium carbonate, potassium carbonate and mixtures thereof;

directing the molten Kraft smelt to an electrolytic cell at a temperature of from about 750° C. to about 950° C.;

electrolytically treating the molten Kraft smelt in a system without liquid water at electrical potential which is effective for preventing reactions of sulfide in the molten Kraft smelt to provide a treated molten Kraft melt and to convert at least about 75% of the alkali metal carbonates therein to alkali metal oxide or alkali metal hydroxide, the method being effective for providing sodium sulfide to the Kraft process, the potential between the anode and the cathode with the molten Kraft smelt therebetween in an environment that is substantially without liquid water; and contacting the treated molten Kraft smelt with water to produce a caustic liquor.

12. A method in accordance with claim 11, wherein electrolytic treatment of the molten Kraft smelt occurs in an electrolytic cell having an anode and a cathode, the method further comprising applying an electrical potential between the anode and the cathode.

13. A method in accordance with claim 12, wherein the cathode is comprised of a material selected from the group consisting of carbon, graphite, stainless steel, titanium diboride, brass and bronze.

14. A method in accordance with claim 13, wherein the anode is comprised of a material selected from the group consisting of metal alloy and ceramic.

15. A method in accordance with claim 12, wherein the anode is comprised of carbon.

16. A method in accordance with claim 12 further comprising introducing steam to the molten Kraft smelt at the cathode.

* * * * *